United States Patent [19]

Diard et al.

[11] Patent Number: 4,838,572

[45] Date of Patent: Jun. 13, 1989

[54] SKI WITH INCLINED LATERAL SURFACES

[75] Inventors: Jean-Luc Diard, Annecy; Roger Pascal, Annecy Le Vieux, both of France

[73] Assignee: Salomon S.A., Annecy Cedex, France

[21] Appl. No.: 49,933

[22] Filed: May 15, 1987

[30] Foreign Application Priority Data

May 23, 1986 [FR] France ..... 86 07849

[51] Int. Cl.[4] ..... A63C 5/048

[52] U.S. Cl. ..... 280/609; 441/68

[58] Field of Search ..... 280/601, 608, 609, 600, 280/28; 441/65, 68, 79; 114/274, 283, 288

[56] References Cited

U.S. PATENT DOCUMENTS

| | | | |
|---|---|---|---|
| Re. 29,659 | 6/1978 | Bildner | 280/608 |
| 4,443,855 | 2/1984 | Wyke | 280/609 |

FOREIGN PATENT DOCUMENTS

| | | |
|---|---|---|
| 1958349 | 5/1971 | Fed. Rep. of Germany . |
| 2461890 | 10/1976 | Fed. Rep. of Germany . |
| 3308599 | 9/1983 | Fed. Rep. of Germany . |
| 3441058 | 5/1986 | Fed. Rep. of Germany . |
| 1343014 | 10/1963 | France . |
| 2509185 | 1/1983 | France . |
| 2517548 | 6/1983 | France . |
| 2522976 | 9/1983 | France . |
| 2559673 | 8/1985 | France . |
| 43-24330 | 10/1968 | Japan . |

*Primary Examiner*—David M. Mitchell
*Assistant Examiner*—Tamara L. Finlay
*Attorney, Agent, or Firm*—Sandler & Greenblum

[57] ABSTRACT

A ski including a lower sliding surface connected to an upper surface by two lateral surfaces along opposed sides of the ski. At least one of the lateral surfaces has at least one portion which is inclined with respect to the lower surface and forms an angle of inclination.

45 Claims, 4 Drawing Sheets

Fig. 3
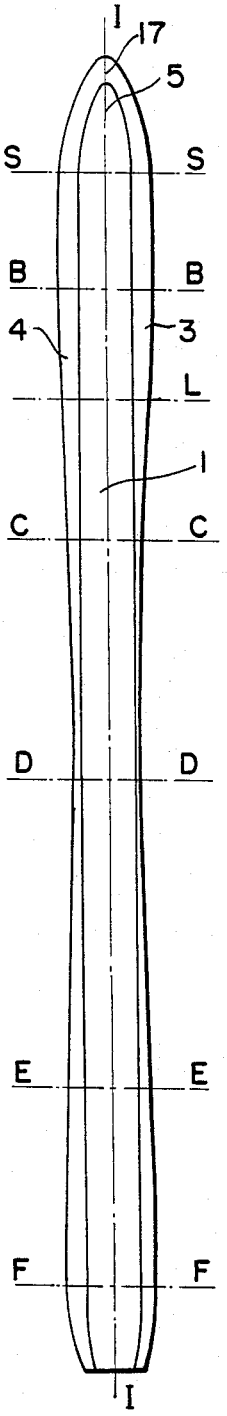
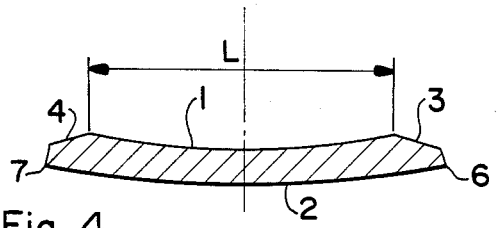
Fig. 4
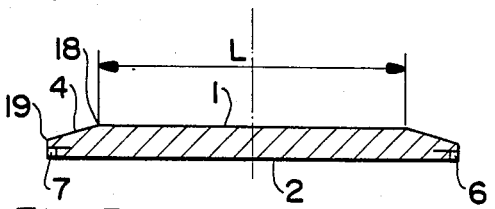
Fig. 5
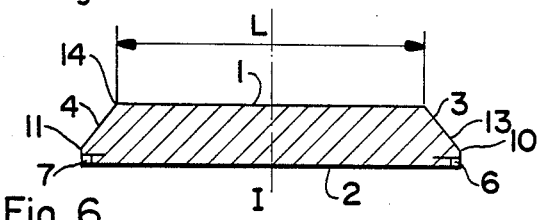
Fig. 6
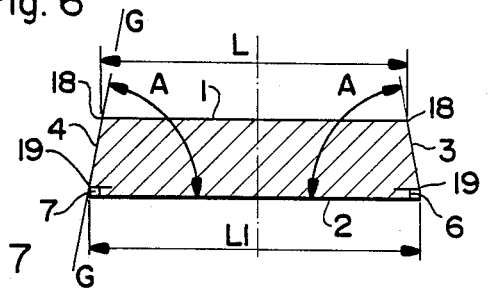
Fig. 7
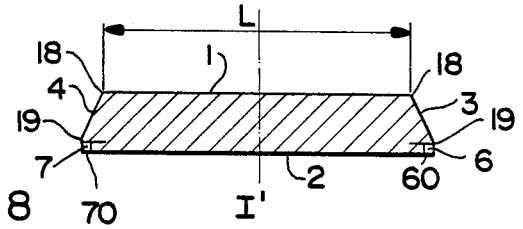
Fig. 8
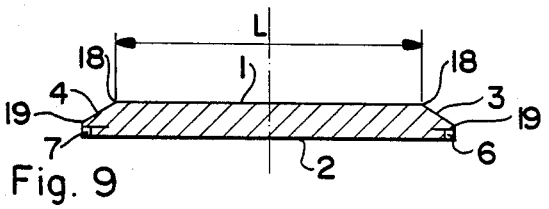
Fig. 9

SKI WITH INCLINED LATERAL SURFACES

BACKGROUND OF THE INVENTION

1. Field of the Invention

The present invention relates to skis utilized in winter sports, and adapted to slide on snow and ice.

2. Description of Background and Relevant Information

Skis generally comprise a lower sliding surface connected to two lateral surfaces along two lower edges provided with metallic corners, the lateral surfaces being connected to a upper surface. Skis have a relatively small width with respect to their length, particularly, their front ends are curved upwardly to form a spatula. The thickness of the ski is generally more pronounced in the central portion than in the front and rear portions. The width of the lower surface is smaller in the central portion of the skis than in the front and rear portions.

Conventionally, skis have a transverse cross-section, which is substantially rectangular, i.e., the lateral surfaces are perpendicular to the lower and upper surfaces.

This shape of skis is appropriate for their use on compact and groomed snow. However, it has been observed that this traditional configuration of skis is disadvantageous, particularly, during skiing on wet snow or frozen snow. In effect, on wet snow, the lateral perpendicular surfaces create tremendous friction during sliding in a longitudinal direction. Furthermore, during a turn, the lateral surfaces oppose flat pivoting of the skis.

Similarly, when skiing on frozen snow, the lateral surfaces oppose penetration of the skis' corners in the snow.

SUMMARY OF THE INVENTION

An object of the invention is to provide a ski for use or snow or ice which comprises an upper surface having a first edge and a second edge connected to a first edge portion and a second edge portion of a lower sliding surface by two lateral surfaces, respectively. The lower surface includes a contact zone composed of a central zone and two end zones. At least one of the two lateral surfaces have at least one portion which is inclined relative to the lower surface thereby forming an inclination angle between the lower surface and the lateral surface of less than 90°, and preferably, between approximately 70°-90° along the entire length of the ski. Alternatively, both of the lateral surfaces are inclined relative to the lower sliding surface, whereby each of them makes an inclination angle of 90°, or preferably between 70°-90°. In another embodiment, a substantial portion of one or both of the lateral surfaces are inclined relative to the lower surface. The angle of inclination of each of the lateral surfaces is variable along the length of the ski.

It is another object of the invention to provide a ski wherein the first lateral surface angle of inclination is the same as the second lateral surface angle of inclination at any longitudinal position of the ski.

The ski of the present invention further includes a front zone, a central zone, and a rear zone, respectively, located along the length of the ski wherein the front zone includes a tip portion which is curved upwardly to form a spatula. The first and second lateral surfaces converge at the spatula such that the first and second lateral surface angles of inclination decrease progressively towards zero at the tip portion of the ski.

It is another object of the invention to provide a ski wherein the average angle of inclination of one or both of the lateral surfaces in the central zone is greater than the average angles of inclination in the front zone or the rear zone. The average angles of inclination in the front and the rear zone are each between about 10°-30°, and in the central zone the average angle of inclination is between about 70°-90°.

The average angle of inclination is substantially constant in the central zone and continuously decreases within the front and the rear zones.

Each of the lateral surfaces includes an upper inclined portion and a lower substantially vertical portion, wherein the upper inclined portion is substantially planar, curvilinear, convex, or concave. Similarly, the upper surface of the ski is substantially planar, however, it can be made curvilinear, i.e., concave.

It is another object of the invention to provide a ski wherein the first lateral surface angle of inclination is greater or smaller than the second lateral surface angle of inclination at any longitudinal position of the ski.

In the ski of the present invention, the width of the upper surface is substantially constant over the entire length of the ski and the width of the lower surface is variable over the length of the ski, however, a vertical median plane of the upper surface is coincident with a vertical median plane of the lower sliding surface. The distance between the upper surface and the lower sliding surface is likewise variable along the entire length of the ski such that the ski is thickest in the central zone and thinnest in the front zone or the rear zone. Each of the first and second edge portions of the lower surface are provided with a metallic corner.

In another embodiment, the angles of inclination of each of the lateral surfaces are continuously variable along the length of the ski.

BRIEF DESCRIPTION OF THE DRAWINGS

Other objects, characteristics, and advantages of the present invention will become clear from the following description with respect to particular embodiments, given with reference to the annexed drawings, in which:

FIG. 3 is a top plan view of the ski;

FIGS. 4–9 illustrates transverse cross-sections of the ski at various locations along its length;

DESCRIPTION OF PREFERRED EMBODIMENTS

The present invention has particularly, as an object of avoiding the disadvantages associated with conventional ski structures, by proposing a new configuration, in which the friction of the lateral surfaces is considerably diminished, even eliminated, during sliding in a longitudinal direction.

Furthermore, during turning or lateral sliding in wet snow, the zones of the lateral surfaces close to the ends of the ski cut into the snow, and thus produce a very low resistance to rotation of the ski and to the onset of the turn.

According to the invention, the shapes of the lateral surfaces of the ski considerably improve the ease of skiing in hard or frozen snow.

According to a preferred embodiment, one distributes in a regular and non-uniform fashion the resistance to a lateral displacement parallel to the sliding surface, the resistance being greater at the center of the ski and lower at the two ends. This distribution substantially increases the maneuverability of the ski.

In the description of the invention, the term "average angle of inclination" means an average of all internal angles of inclination formed by a lower sliding surface and one of the lateral surfaces in a particular zone, for example, front end of a contact zone, or the entire longitudinal length of the ski. Alternatively, the term "angle of inclination", means an angle formed by the lower sliding surface and one of the lateral surfaces at a point along the longitudinal length of the ski.

To achieve these objects as well as others, at least one of the lateral surfaces of the ski forms, with the lower surface of the ski, an interior inclination angle, which is variable in a continuous fashion along the length of the body of the ski as a function of a longitudinal position being considered. The average inclination angle in the central zone of the ski is greater than the average angle of inclination adjacent to at least one of the ends of the contact zone of the ski. The contact zone of the ski is the part of the lower surface which is in contact with a planar surface when the ski is applied on the surface, and it extends from a point directly behind the spatula to the rear end of the ski.

A first embodiment comprises providing an average inclination angle which is smaller adjacent to the front end of the contact zone, thus favoring lateral sliding of the front portion of the ski.

By utilizing a small average inclination angle in the rear portion, one favors the lateral sliding of the rear portion.

By utilizing a small inclination angle at one end of the ski, the other end favors flat rotation of the ski, and the central zone of the ski, thus forms a lateral support surface which is more resistant to lateral sliding.

Figure 1:
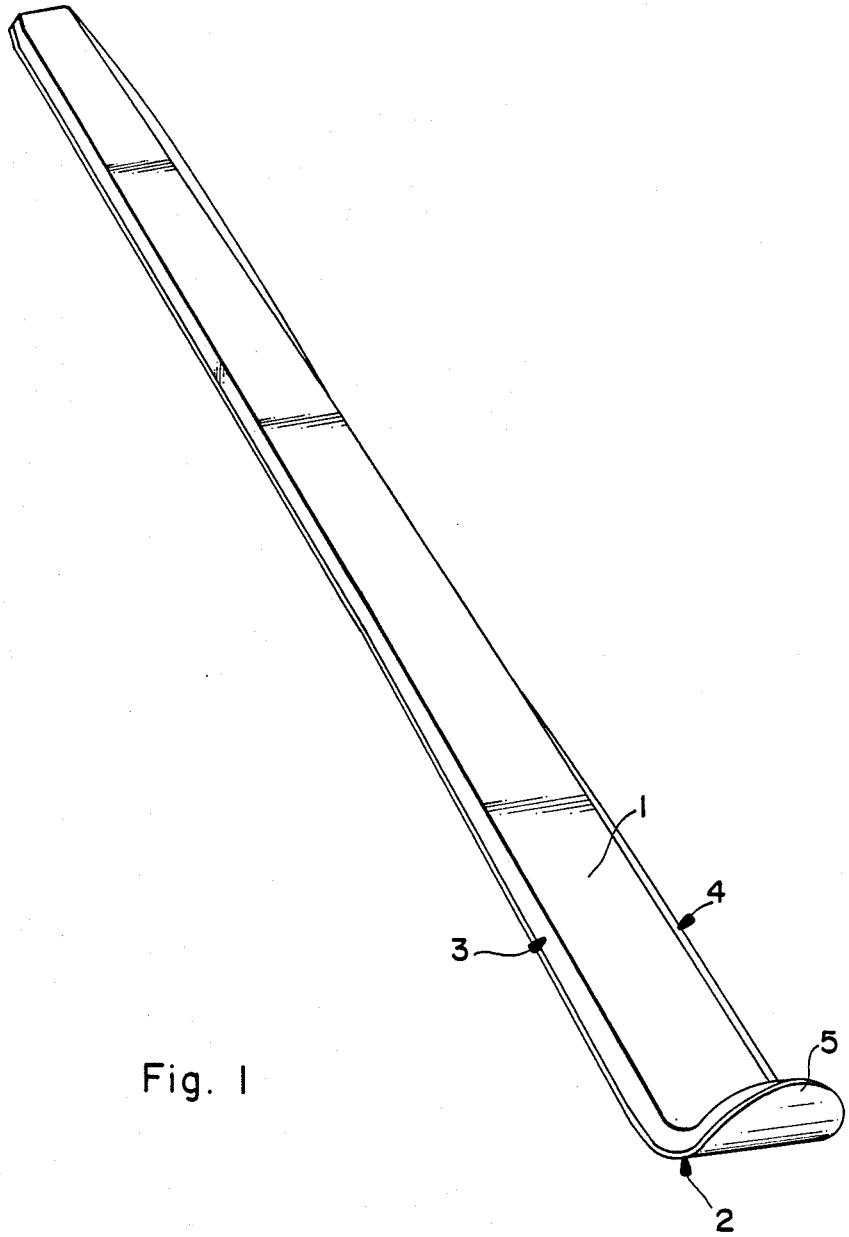
FIG. 1 illustrates a perspective view of the ski according to the invention.
Figure 2:
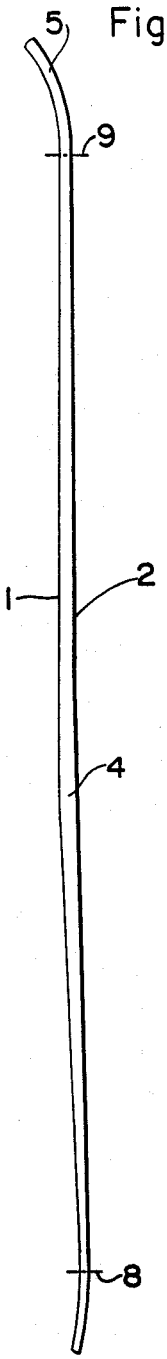
FIG. 2 illustrates a side view of the ski.

As shown in the Figures, the ski according to the invention comprises an upper surface 1, a lower sliding surface 2, and two lateral (or bevelled) surfaces 3 and 4. The front portion of the ski is curved upwardly to form a spatula 5. The lower surface is arched, in a known fashion, and is bordered by two longitudinal lower edges 6 and 7 provided preferably, with metallic corners 60 and 70, respectively. The central zone of the lower surface, shown in transverse cross-section D-D in FIG. 7, has a width less than that of the two end zones B-B and F-F shown respectively, in FIGS. 5 and 9, the variation of width being continuous. The lower surface has a contact zone, shown in FIG. 2, defined between numerals 8 and 9. Numerals 8 and 9 are, respectively, at the level of the rear line of contact and of the front line of contact of the ski.

The thickness of the ski, or the distance separating the upper surface 1 and the lower surface 2, is likewise variable along a longitudinal position of the ski. The central zone of the ski, shown in cross-section D-D in FIG. 7, has a greater thickness than the end zones shown in FIGS. 5 and 9.

Each lateral surface 3 and 4, forms with lower surface 2 of the ski, a predetermined interior inclination angle A as shown in FIG. 7. The average inclination angle A is variable along the length of the body of the ski as a function of the longitudinal position of the ski which is being considered.

As shown in FIGS. 4–9, lateral surfaces 3 and 4 comprise a lower portion, constituted by respective substantially vertical portions 10 and 11, and an upper inclined zone 13 and 14, respectively, having average inclination angle A. The lower zones 10 and 11 preferably have a height of several millimeters.

The upper zones 13 and 14 may be defined by an imaginary straight line, such as line G-G of FIG. 7, extending beyond the lower zone 10 and the upper edge 18. The interior inclination angle A is, thus, formed by the lower surface and by straight line G-G.

Figure 11:
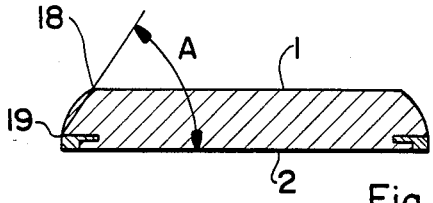
FIGS. 11–14 are views similar to FIG. 6, showing alternative embodiments.
Figure 12:
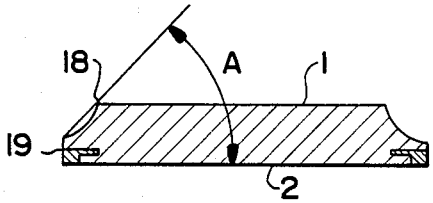

According to another embodiment, the shape of the lateral surfaces and/or the shape of the upper zones 13 and 14 can be curvilinear, convex as shown in FIG. 11, or concave as shown in FIG 12. Thus, one defines the interior inclination angle A of a section being considered as being the angle formed by the lower surface 2 and a straight line joining the upper edge 18 and the junction line 19 between the lower zone 10 and the upper zone 13.

The inclination angle A varies in a continuous fashion along the length of the body of the ski, i.e., the value does not have a discontinuity or rapid variation. One understands by rapid variation to mean a variation of more than 10° between two transverse cross-sections of the ski spaced by a centimeter, i.e., if two transverse cross-sections of the ski separated by a distance of about 1 centimeter are compared, the inclination angle of one cross-section would not be different by more than 10° than the inclination angle of the other section. In the central zone of the ski, adjacent the section D-D, the average inclination angle A is greater than the average inclination angle in the end zones shown by sections B-B and F-F. More specifically, in the central zone, the average inclination angle A is between about 70° and 90°. In the end zones B-B and F-F of the body of the ski, the average inclination angle is between 10° and 30°.

Figure 10:
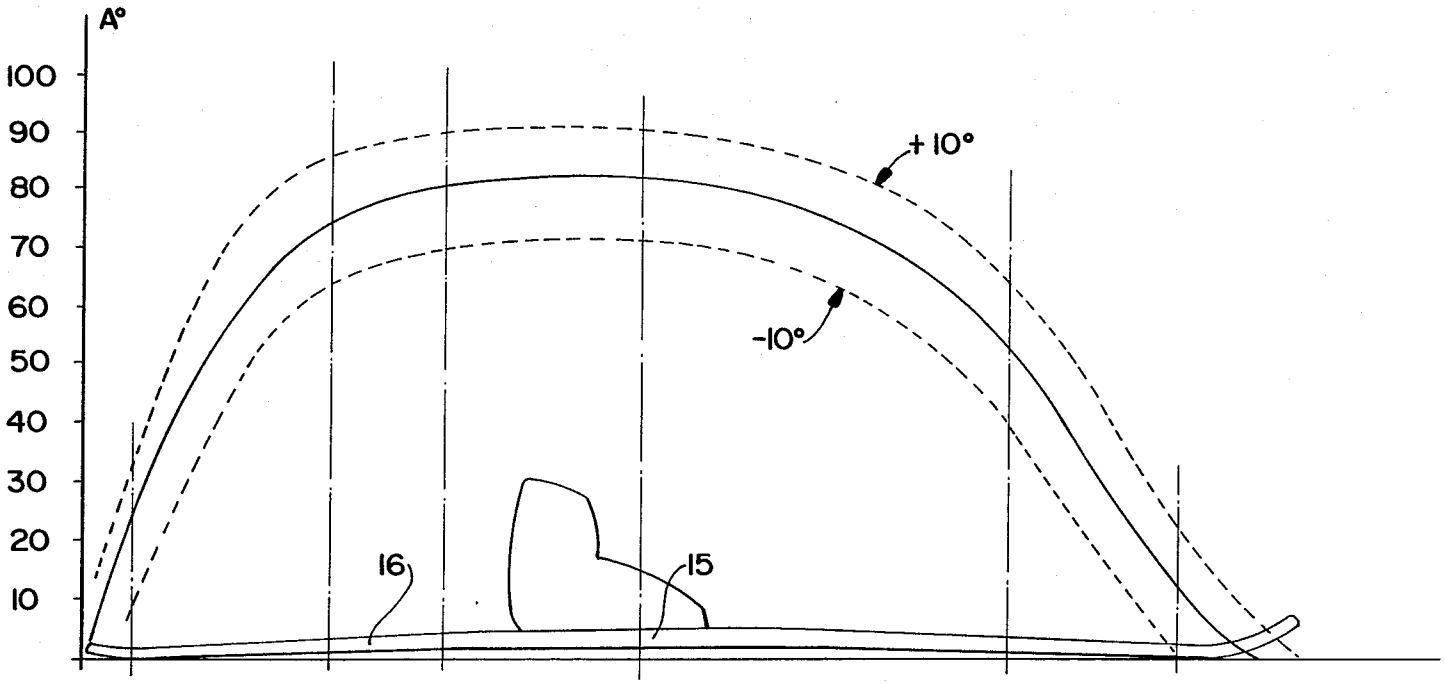
FIG. 10 illustrates the variations in the inclination angle of the lateral surfaces as a function of their position along the length of the ski.

FIG. 10 illustrates the curve of inclination angle A as a function of a position along the length of the ski, in a particular embodiment. The average inclination angle A is substantially constant in the intermediate zone included between the region 15 and the rear section 16. Angle A decreases regularly towards the front and towards the rear of the intermediate zone to reach, adjacent the ends B-B and F-F of the ski, a value of less than approximately 20°.

In the zone of spatula 5, lateral surfaces 3 and 4 extend in a regular fashion, the average inclination angle A progressively diminishing when one approaches to point 17 of the ski.

Thus, preferably, the average inclination angle A is less than 90°, over the entire length of the ski, i.e., lateral surfaces 3 and 4 converge upwardly.

Figure 13:
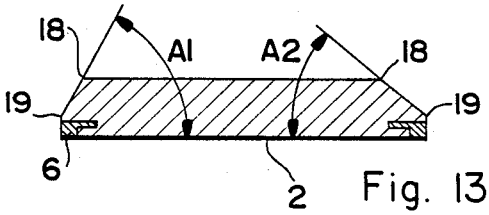

In the embodiment described in the Figures, lateral surfaces 3 and 4 are symmetrical to one another with respect to a median longitudinal vertical plane I-I of the ski. It is, however, possible to provide lateral surfaces which are different from one another, to produce differential effects of the ski as shown in FIG. 13. According to this alternative embodiment, it is seen that one of the lateral surfaces forms an angle A1 with lower surface 2 of the ski, while the other lateral surface forms an angle A2, which is different from A1, such that A2 is less than A1. As a result, the lateral surfaces of the ski are dissymmetrical with respect to the median longitudinal vertical plane I-I of the ski. FIG. 13, preferably, shows a right ski in cross-section, but it could just as well illustrate a left ski.

Figure 14:
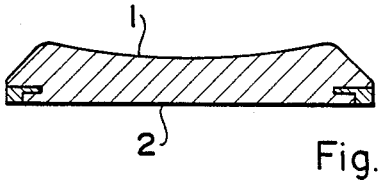
Figure 15:
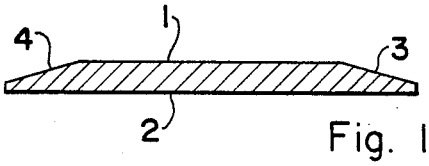
FIG. 15 is a view similar to FIG. 4, illustrating an alternative embodiment.

It is within the scope of the invention to make the upper surface of the ski concave, as shown in FIG. 14. Similarly, it is within the scope of the invention to make the lower surface of the spatula flat, as shown in FIG. 15.

Although the invention has been described with reference to particular means, materials and embodiments, it is to be understood that the invention is not limited to the particular embodiments disclosed, and extends to all equivalents within the scope of the claims appended hereto.

What is claimed is:

1. A ski for use on snow or ice, comprising:

a lower sliding surface connected to an upper surface by two lateral surfaces along opposed sides of the ski, each of said lateral surfaces being inclined with respect to said lower surface and having at least one angle of inclination with respect to said lower surface, wherein the inclination angle of at least one of said lateral surfaces is variable along the longitudinal extent of said ski, said lower surface comprising a contact zone including a central zone and two end zone, the average inclination angle of said at least one lateral surface in said central zone of said ski being greater than the average inclination angle of said at least one lateral surface along at least one of said end zones, wherein said inclination angle of said at least one of said lateral surfaces decreases substantially continuously along at least a portion of the length of said ski from said central zone toward at least one of said end zones.

2. The ski of claim 1, wherein said average inclination angle in said central zone is greater than the average inclination angle at a front end zone of said contact zone.

3. The ski of claim 1, wherein said average inclination angle in said central zone is greater than the average inclination angle at a rear end zone of said contact zone.

4. The ski of claim 1, wherein said lateral surfaces are symmetrical to one another with respect to a median longitudinal vertical plane of the ski.

5. The ski of claim 1, wherein said lateral surfaces are dissymmetrical with respect to one another and with respect to a vertical longitudinal median plane of the ski.

6. The ski of claim 1, wherein said average inclination angle is less than 90° over the entire length of the ski.

7. The ski of claim 1, wherein said average inclination angle in said central zone is between about 70°-90°.

8. The ski of claim 1, wherein said average inclination angle at each end of said contact zone is between about 10°-30°.

9. The ski of claim 1, wherein each of said lateral inclined surfaces extends onto a spatula, and wherein the inclination angle decreases progressively from said central zone towards said spatula.

10. The ski of claim 1, wherein each of said lateral surfaces comprises a lower portion substantially perpendicular to said lower surface of the ski, and an upper inclined portion defining said inclination angle at any point along the ski.

11. The ski of claim 1, wherein said average inclination angle is substantially constant in said central zone, said inclination angle decreasing continuously within said front and rear zones towards the ends of said ski wherein the inclination angle at the ski ends is less than approximately 20°.

12. A ski for sliding on ice or snow, comprising:

(a) an upper surface comprising a first edge and a second edge;

(b) a lower sliding surface comprising a first edge portion and a second edge portion;

(c) a plurality of lateral surfaces, whereby a first one of said lateral surfaces connects said first edge of said upper surface with said first edge portion of said lower surface, and a second one of said lateral surfaces connects said second edge of said upper surface with said second edge portion of said lower surface; and (d) a forward end and a rearward end; wherein at least one of said lateral surfaces has at least one portion which is inclined relative to said lower surface thereby forming at least one inclination angle between said surface and said lateral surface; wherein said at least one inclination angle decreases substantially continuously toward at least one of said forward end and said rearward end.

13. The ski of claim 12, wherein at least a portion of each of said first lateral surface and said second lateral surface are inclined relative to said lower surface, wherein each lateral surface forms at least one said inclination angle.

14. The ski of claim 13, wherein said angle of inclination of each said lateral surfaces is variable along the length of the ski.

15. The ski of claim 13, wherein the average angle of inclination of the first lateral surface and the average angle of inclination of the second surface are each less than 90°, over the entire length of the ski.

16. The ski of claim 13, wherein said first lateral surface average angle of inclination and said second lateral surface average angle of inclination are each between approximately 70°-90°.

17. The ski of claim 13, wherein said first lateral surface angle of inclination is the same as said second lateral surface angle of inclination at any longitudinal position of the ski.

18. The ski of claim 12, further comprising a front zone, a central zone, and a rear zone, respectively, along the length of the ski, said front zone comprising a tip portion which is curved upwardly to form a spatula.

19. The ski of claim 18, wherein said average angle of inclination of at least one lateral surface in said central zone is greater than said average angle of inclination in said front zone.

20. The ski of claim 18, wherein said average angle of inclination of at least one lateral surface in said central zone is greater than said average angle of inclination in said rear zone.

21. The ski of claim 18, wherein said average angle of inclination in said front zone of at least one lateral surface is between about 10°-30°.

22. The ski of claim 18, wherein said average angle of inclination in said central zone is between about 70°-90°.

23. The ski of claim 18, wherein said average angle of inclination in said rear zone is between about 10°-30°.

24. The ski of claim 18, wherein said first lateral surface and said second lateral surface converge at said spatula such that said first and second lateral surface angles of inclination decrease progressively towards zero at said tip portion of the ski.

25. The ski of claim 13, wherein said first lateral surface and said second lateral surface each comprises an upper inclined portion and a lower substantially vertical portion.

26. The ski of claim 18, wherein said average angle of inclination is substantially constant in said central zone and continuously decreases within said front zone.

27. The ski of claim 18, wherein said average angle of inclination is substantially constant in said central zone and continuously decreases within said rear zone.

28. The ski of claim 25, wherein said upper inclined portion is curvilinear.

29. The ski of claim 28, wherein said upper inclined portion is convex.

30. The ski of claim 28, wherein said upper inclined portion is concave.

31. The ski of claim 25, wherein said upper surface is curvilinear.

32. The ski of claim 31, wherein said upper surface is concave.

33. The ski of claim 18, wherein each of said lower sliding surface and said upper surface of said spatula are is substantially planar.

34. The ski of claim 14, wherein said first lateral surface angle of inclination is greater than said second lateral surface angle of inclination at any longitudinal position of the ski.

35. The ski of claim 14, wherein said first lateral surface angle of inclination is smaller than said second lateral surface angle of inclination at any longitudinal position of the ski.

36. The ski of claim 25, wherein said upper inclined portion is substantially planar.

37. The ski of claim 12, wherein a vertical median plane of said upper surface is coincident with a vertical median plane of said lower sliding surface.

38. The ski of claim 12, wherein the width of said upper surface is substantially constant over the entire length of the ski, and the width of said lower surface is variable over the entire length of the ski.

39. The ski of claim 17, wherein the distance between said upper surface and said lower sliding surface is variable along the entire length of the ski.

40. The ski of claim 39, wherein said distance between said upper and lower surfaces is greatest in said central zone.

41. The ski of claim 39, wherein said distance between said upper and lower surfaces in each said front zone and said rear zone is less than said distance in said central zone of the ski.

42. The ski of claim 12, wherein said first edge portion and said second edge portion each comprises a metallic corner.

43. The ski of claim 13, wherein said angles of inclination of each of said lateral surfaces are continuously variable along the length of the ski.

44. The ski of claim 12, wherein a substantial portion of one of said lateral surfaces is inclined relative to said lower surface.

45. The ski of claim 13, wherein a substantial portion of each of said first lateral surface and said second lateral surface are inclined relative to said lower surface.

* * * * *

UNITED STATES PATENT AND TRADEMARK OFFICE

CERTIFICATE OF CORRECTION

PATENT NO. : 4,838,572

DATED : June 13, 1989

INVENTOR(S) : Jean-Luc DIARD et al.

It is certified that error appears in the above-identified patent and that said Letters Patent is hereby corrected as shown below:

At column 1, line 14, change "a" to ---an--- after "to".

At column 1, line 39, change "or" to ---on--- before "snow".

At column 5, line 32, change "zone" to ---zones --- after "end".

At column 7, line 27, i.e. claim 33, line 2, delete "are" after "spatula".

Signed and Sealed this

Twelfth Day of November, 1991

*Attest:*

HARRY F. MANBECK, JR.

*Attesting Officer*

*Commissioner of Patents and Trademarks*